US010920610B2

(12) United States Patent
Ghigliotty

(10) Patent No.: US 10,920,610 B2
(45) Date of Patent: Feb. 16, 2021

(54) CASTING PLUG WITH FLOW CONTROL FEATURES

(71) Applicant: United Technologies Corporation, Farmington, CT (US)

(72) Inventor: Jaime G. Ghigliotty, Cabo Rojo, PR (US)

(73) Assignee: Raytheon Technologies Corporation, Farmington, CT (US)

( * ) Notice: Subject to any disclaimer, the term of this patent is extended or adjusted under 35 U.S.C. 154(b) by 275 days.

(21) Appl. No.: 16/004,724

(22) Filed: Jun. 11, 2018

(65) Prior Publication Data

US 2019/0376415 A1 Dec. 12, 2019

(51) Int. Cl.

| | |
|---|---|
| ***F01D 25/12*** | (2006.01) |
| ***B22D 45/00*** | (2006.01) |
| ***F01D 9/04*** | (2006.01) |

(52) U.S. Cl.

CPC ..... *F01D 25/12* (2013.01); *B22D 45/00* (2013.01); *F01D 9/041* (2013.01); *F05D 2230/232* (2013.01); *F05D 2240/12* (2013.01); *F05D 2240/81* (2013.01); *F05D 2260/22141* (2013.01)

(58) Field of Classification Search

CPC ..... F01D 25/12; F01D 9/041; F01D 9/065; F01D 5/14; F01D 5/147; F01D 5/187; F01D 5/188; F01D 5/189; B22D 45/00; B22D 19/0072; B22C 9/10; B22C 9/24; F05D 2230/211; F05D 2230/232; F05D 2240/81; F05D 2240/12; F05D 2240/126; F05D 2260/22141

USPC ..... 415/115

See application file for complete search history.

(56) References Cited

U.S. PATENT DOCUMENTS

| | | | | |
|---|---|---|---|---|
| 6,589,010 | B2 * | 7/2003 | Itzel | F01D 5/187 415/1 |
| 8,360,716 | B2 | 1/2013 | Bergman et al. | |
| 10,329,916 | B2 | 6/2019 | Quach et al. | |
| 2009/0185893 | A1 | 7/2009 | Propheter-Hinckley | |
| 2014/0000285 | A1 | 1/2014 | Bergman et al. | |
| 2014/0093386 | A1 * | 4/2014 | Pointon | F01D 5/20 416/96 R |
| 2016/0312632 | A1 * | 10/2016 | Hagan | F01D 5/147 |

FOREIGN PATENT DOCUMENTS

EP 2942485 A1 11/2015

OTHER PUBLICATIONS

European Search Report dated Aug. 16, 2019 issued for corresponding European Patent Application No. 19179266.2.

* cited by examiner

*Primary Examiner* — Justin D Seabe
*Assistant Examiner* — Justin A Pruitt
(74) *Attorney, Agent, or Firm* — Bachman & LaPointe, P.C.

(57) ABSTRACT

A casting plug for a vane of a gas turbine engine includes a plug body a flow control feature and a support that extends between the plug body and the flow control feature.

21 Claims, 7 Drawing Sheets

CASTING PLUG WITH FLOW CONTROL FEATURES

BACKGROUND

The present disclosure relates to a gas turbine engine and, more particularly, to a casting plug that includes a flow control feature such that the feature need not be cast into the vane geometry.

Various gas turbine engines such as those utilized in aerospace and industrial gas turbine engine applications often rely on high turbine inlet temperatures to improve overall engine performance. In typical engine applications, the gas path temperatures within the high pressure turbine can exceed the melting point of the turbine components such that dedicated cooling air is extracted from the compressor section to cool the turbine components.

Most cooling scheme designs include bends that connect passages within the airfoil. Flow complexities, such as flow separation, may occur at these bends which detriment the convective cooling. To facilitate flow around these bends, some castings will include features such as turning ribs to facilitate optimization of the cooling flow effectiveness. However, including the turning rib in the core may result in a casting challenge. The core will be harder to leach and more prone to break. Moreover, the turning rib may result in solidification and porosity issues during the casting process.

SUMMARY

A casting plug for a component of gas turbine engine according to one disclosed non-limiting embodiment of the present disclosure includes a support that extends between a plug body and a flow control feature.

The casting plug as recited in claim 1, wherein the plug body is received within a platform of the vane.

A further aspect of the present disclosure includes that the platform is at least one of an outer platform and an inner platform.

A further aspect of the present disclosure includes that the plug body closes a core support aperture of a vane airfoil.

A further aspect of the present disclosure includes that the flow control feature completes a flow path within the airfoil of.

A further aspect of the present disclosure includes that the flow control feature is located between two flow paths within the airfoil.

A further aspect of the present disclosure includes a turning vane.

A further aspect of the present disclosure includes that the flow control feature forms an airfoil shape.

A further aspect of the present disclosure includes that the flow control feature forms an arcuate shape.

A further aspect of the present disclosure includes that the support is transverse to the flow control feature.

A vane for a gas turbine engine according to one disclosed non-limiting embodiment of the present disclosure includes an airfoil between an outer platform and an inner platform with a plurality of flow passages within the airfoil; and a casting plug received into an aperture in the vane, the casting plug comprising a flow control feature to at least partially define at least one of the plurality of flow passages.

A further aspect of the present disclosure includes that the aperture is a core support aperture of the vane.

A further aspect of the present disclosure includes that at least two of the plurality of flow passages within the airfoil are separated by a rib.

A further aspect of the present disclosure includes that the flow control feature is adjacent to an end of the rib.

A further aspect of the present disclosure includes that the flow control feature is arcuate.

A further aspect of the present disclosure includes a support that extends between a plug body and the flow control feature, wherein the support is transverse to the flow control feature.

A method for manufacturing a component for a gas turbine engine, the method according to one disclosed non-limiting embodiment of the present disclosure includes installing a casting plug into an aperture in the component, the casting plug comprising a flow control feature to at least partially define at least one of a plurality of flow passages within the vane.

A further aspect of the present disclosure includes welding the casting plug into the aperture.

A further aspect of the present disclosure includes wherein the aperture is a core support aperture of a vane.

A further aspect of the present disclosure includes that a thickness of the support controls the cooling flow through the at least one of the plurality of flow passages within the component.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
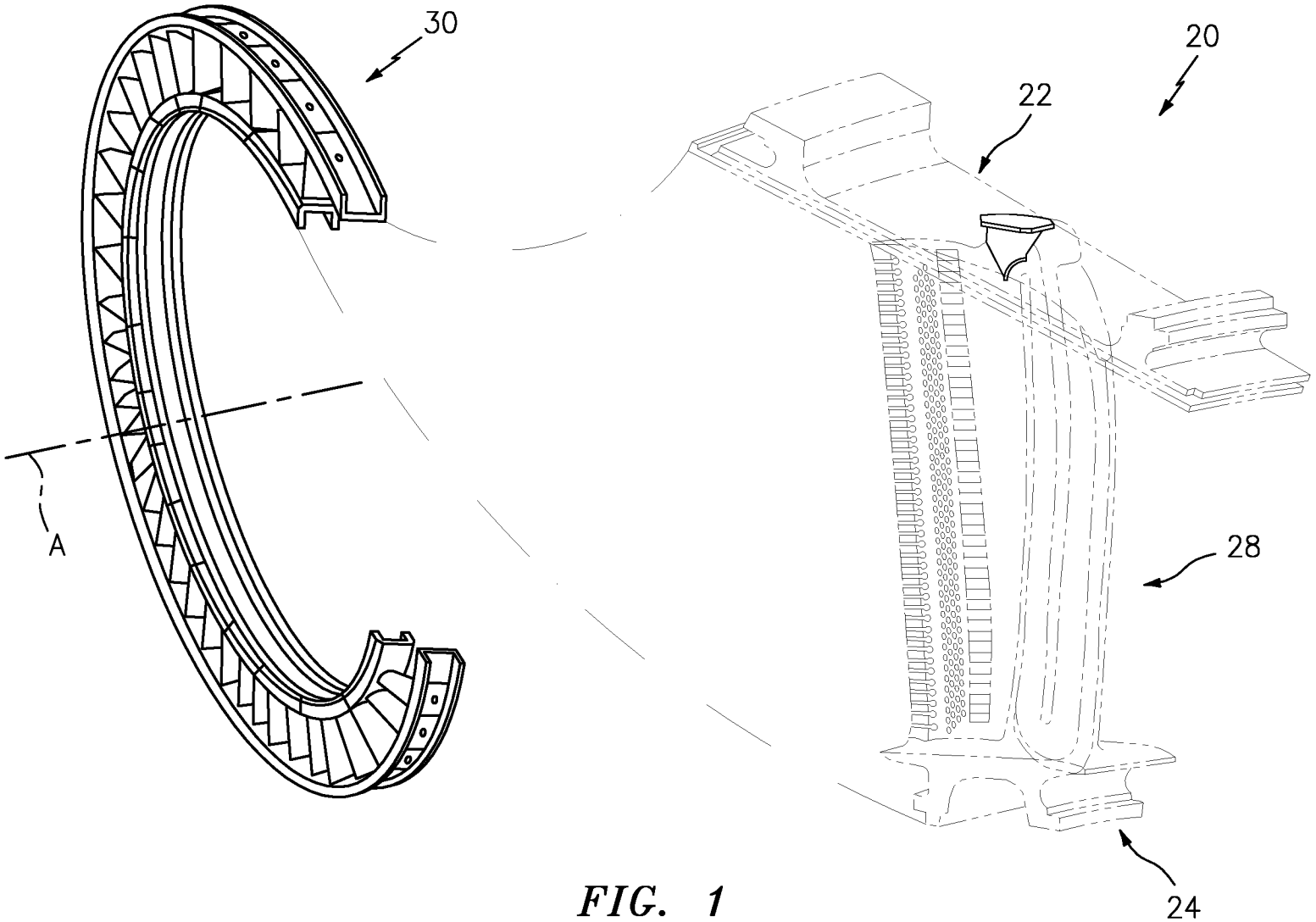
FIG. 1 is a partial exploded view of a vane ring of one turbine stage within a high pressure turbine section of the gas turbine engine, the vane ring formed from a multiple of vane segments.

FIG. 1 schematically illustrates a vane 20 for a gas turbine engine. The vane 20 includes an outer platform 22 and an inner platform 24 radially spaced apart from each other by a vane airfoil 28. The arcuate outer platform 22 may form a portion of an outer core engine structure and the arcuate inner platform 24 may form a portion of an inner core engine structure to at least partially define an annular turbine nozzle core airflow flow path.

The adjacent vanes 20 may be sealed therebetween, with, for example only, spline seals. The substantial aerodynamic and thermal loads are accommodated by the plurality of circumferentially adjoining vane segments which collectively form a full, annular ring 30 about the centerline axis A of the engine. It should be appreciated the any number of vane airfoils 28 may be included in each vane segment. For purposes of this description, the vane 20 will be described as forming a sole airfoil of a segment. Although a portion of a turbine section is shown by way of example in the disclosed embodiment, it should be appreciated that the concepts described herein are not limited to use with high pressure turbines as the teachings may be applied to other components in other engine sections such as blades and vanes within the low pressure turbines, power turbines, intermediate pressure turbines as well as other cooled airfoil structures with any number of stages.

Figure 2:
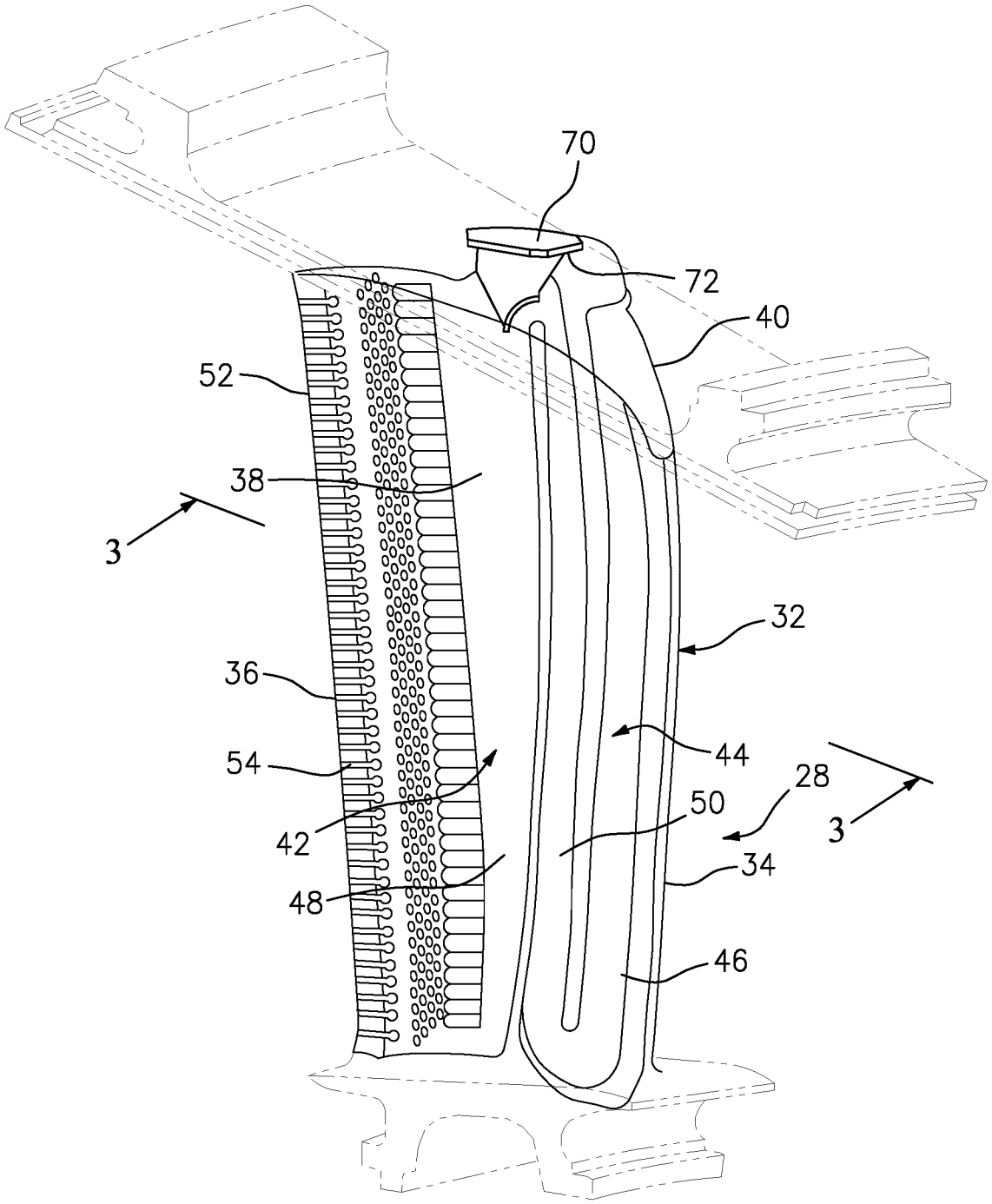
FIG. 2 is an expanded view of one vane segment.

With reference to FIG. 2, each airfoil 28 is defined by an outer airfoil wall surface 32 between a leading edge 34 and a trailing edge 36. The outer airfoil wall surface 32 defines a generally concave shaped portion forming a pressure side 38 and a generally convex shaped portion forming a suction side 40 to form a passage array 42 therein.

Figure 3:
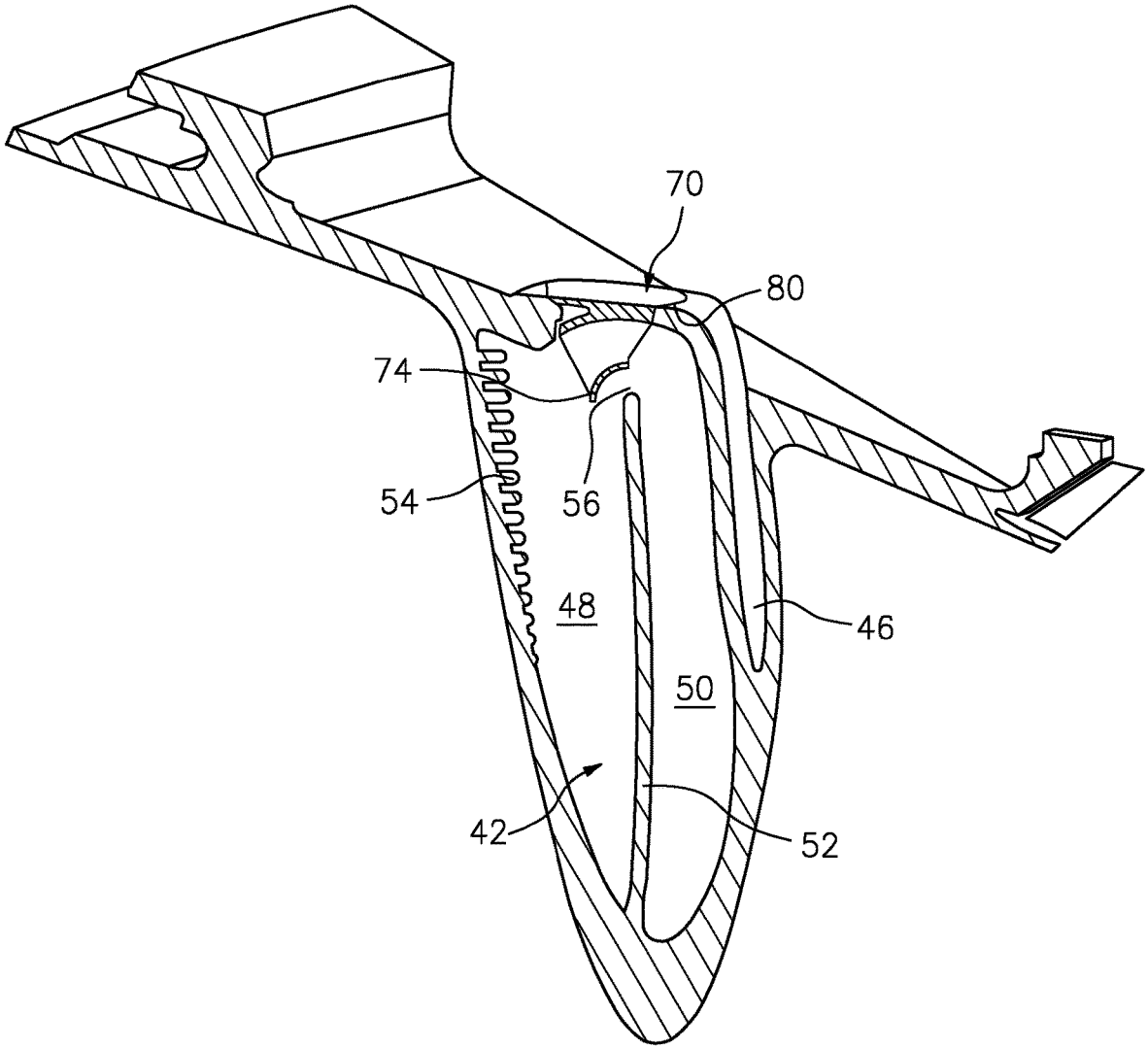
FIG. 3 is a sectional view of the turbine vane illustrating a casting plug according to one disclosed non-limiting embodiment.

In this exemplary embodiment, the passage array 42 has a plurality of flow passages 44, for example, a leading edge passage 46, a trailing edge passage 48 and an intermediate passage 50 (FIG. 3). A multiple of structural ribs 52 are integrally cast between the pressure side 38 and the suction side 40 for supporting the outer airfoil wall surface 32 and to form the passage array 42. The passage array 42 is in flow communication with an airflow source such as a bleed air from a compressor section for impingement and/or convection cooling of the vane 20. The post impingement coolant flows through the passages to outlets 54 such as those adjacent the trailing edge 36.

Figure 4:
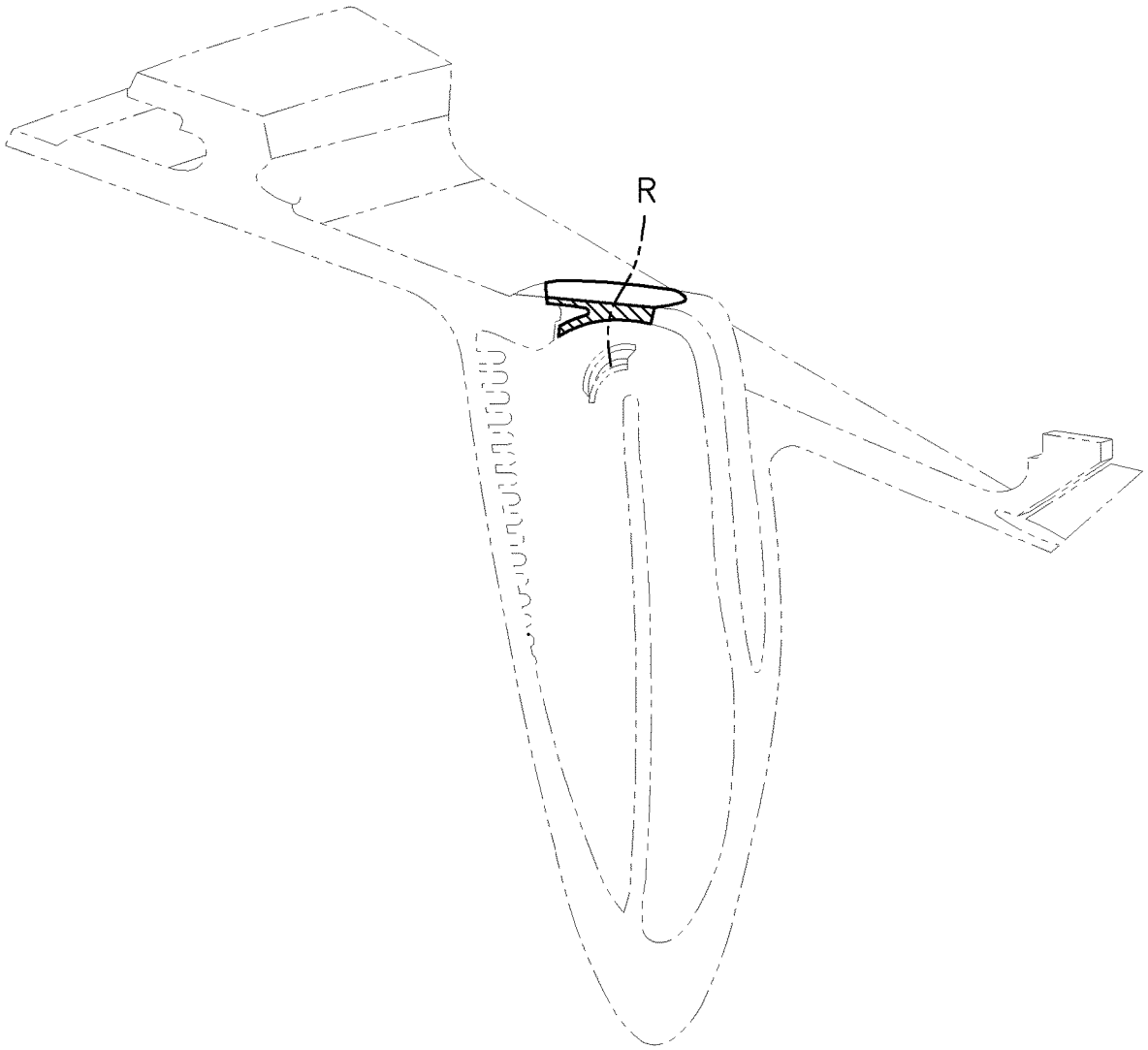
FIG. 4 (RELATED ART)
FIG. 4 is a sectional view of the turbine vane illustrating a RELATED ART casting plug.

A casting plug 70 is welded into the vane airfoil 28 to close an outer diameter core support aperture 80. The casting plug 70 replaces a conventional casting plug and thereby permits the elimination of an outer diameter bend turning rib "R" (FIG. 4; RELATED ART) from the casting by including the turning feature into the casting plug 70.

Figure 5:
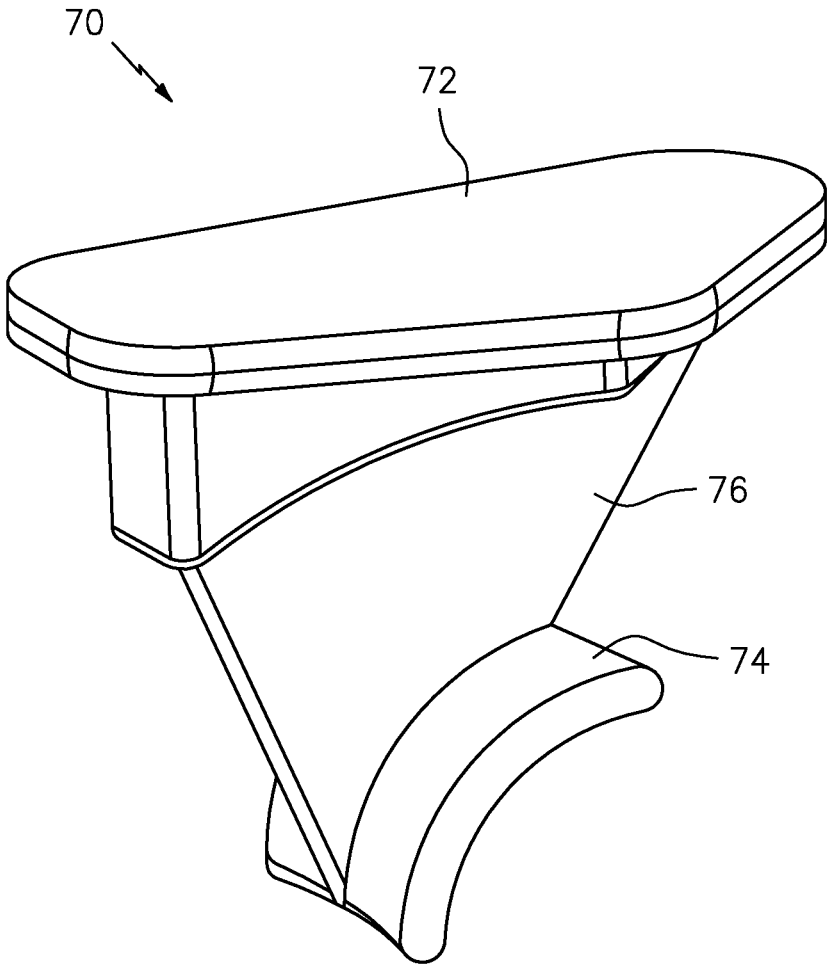
FIG. 5 is a perspective view of the casting plug.

With reference to FIG. 5, the casting plug 70 includes a plug body 72, a flow control feature 74 and a support 76 that extends between the plug body 72 and the flow control feature 74. The casting plug 70 may be additively manufactured or otherwise formed into any desired geometry to minimize or eliminate flow dead zones such that the cooling flow is fully developed at the turn region. The plug body 72 is readily formed to seal the outer diameter core support aperture 80.

The support 76 may be transverse (FIG. 6) to the flow control feature 74. The support 76, in one embodiment, is an extension that locates the flow control feature 74 adjacent to an end 56 (FIG. 3) of the rib 52. The support 76 operates as a flow splitter and the thickness of the support 76 may also be readily configured to control and meter the cooling flow without additional casting changes to the vane airfoil 28.

Figure 6:
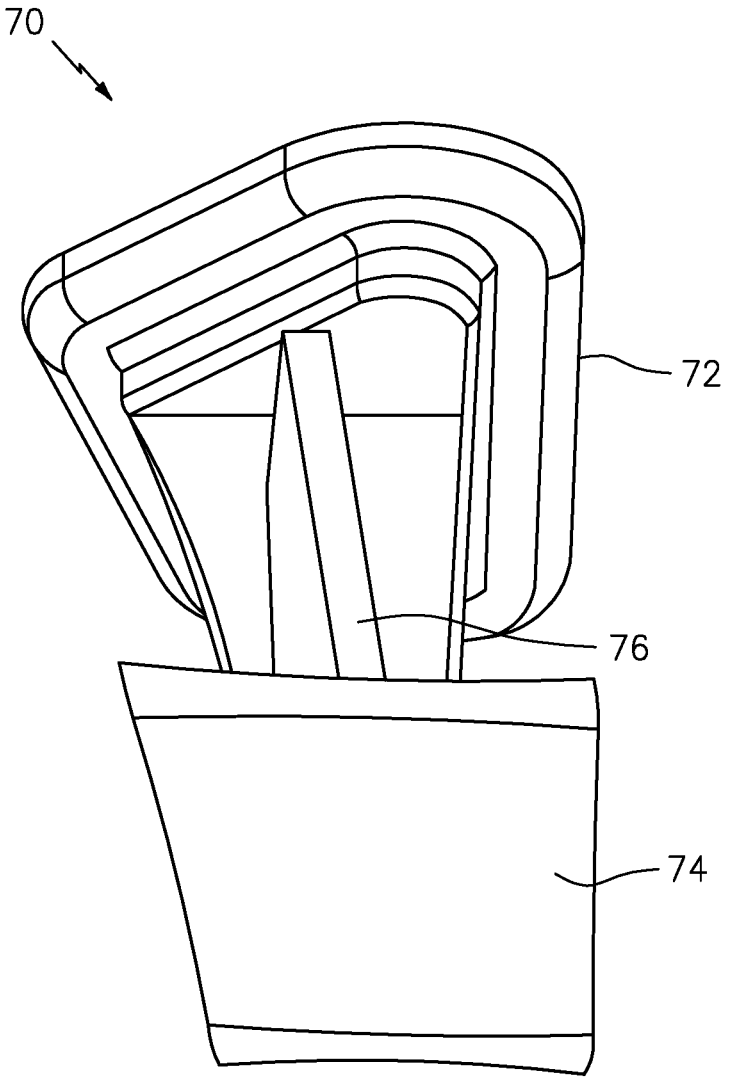
FIG. 6 is a front view of the casting plug.
Figure 7:
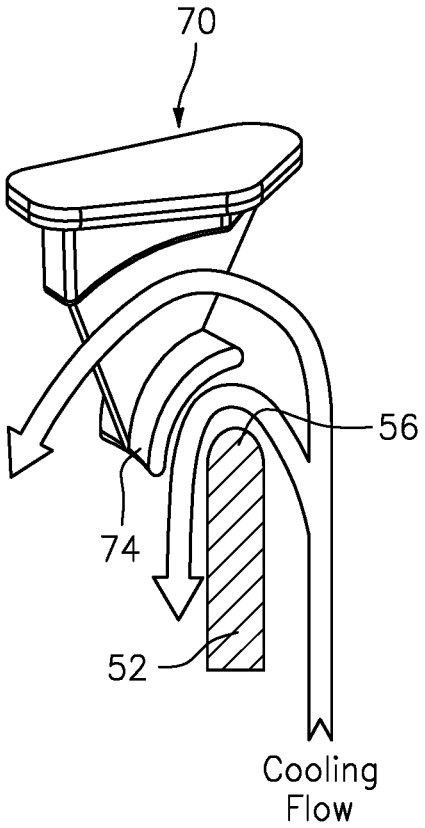
FIG. 7 is a schematic view of cooling flow modified by the casting plug.

The flow control feature 74 may be arcuate, airfoil shaped, or of other geometries to facilitate flow between one or more of the passages in the passage array 42. The flow control feature 74 may be utilized to minimize flow turbulence within the passage array 42 (FIG. 6).

The casting plug 70 eliminates casting problems associated with cast turning ribs. The design may be more castable, easier to leach core and less prone to break. In addition, it will prevent turning rib solidification and porosity issues during the casting process. This reduces scrap rate and manufacturing cost. The casting plug 70 also facilitates full development of the flow for optimum cooling effectiveness at the turn region. The casting plug 70 may also control and meter the cooling flow without the need for additional casting changes by controlling the thickness of the support 76. That is, a different casting plug 70 can be inserted into a common vane airfoil geometry so that the cooling airflow therein may be particularly tailored by replacement of the casting plug 70.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A casting plug for a component of gas turbine engine, comprising:

a plug body that seals a core support aperture of a component;

a flow control feature that extends into a flow path within an airfoil of the component; and a support that extends between the plug body and the flow control feature, the support transverse to the flow control feature to operates as a flow splitter.

2. The casting plug as recited in claim 1, wherein the plug body is received within a platform of a vane.

3. The casting plug as recited in claim 2, wherein the platform is at least one of an outer platform and an inner platform, the airfoil between the outer platform and the inner platform.

4. The casting plug as recited in claim 1, wherein the flow control feature is located between two flow paths within the airfoil.

5. The casting plug as recited in claim 4, wherein the flow control feature comprises a turning vane.

6. The casting plug as recited in claim 4, wherein the flow control feature forms an airfoil shape.

7. The casting plug as recited in claim 4, wherein the flow control feature forms an arcuate shape.

8. The casting plug as recited in claim 1, wherein the plug body forms a portion of an outer periphery of the flow path.

9. The casting plug as recited in claim 1, wherein the casting plug is additively manufactured and the component is cast.

10. The casting plug as recited in claim 1, wherein the flow control feature extends into the flow path within the airfoil of the component to be adjacent to an end of a rib within the airfoil.

11. A vane for a gas turbine engine, comprising:

an outer platform;

an inner platform;

a vane airfoil between the outer platform and the inner platform with a plurality of flow passages within the vane airfoil; and a casting plug received into a core support aperture in one of the outer platform and the inner platform of the vane, the casting plug comprising a flow control feature that extends into a flow path within the vane airfoil from a plug body by a support transverse to the flow control feature at least partially define at least one of the plurality of flow passages within the vane airfoil.

12. The vane as recited in claim 11, wherein at least two of the plurality of flow passages within the airfoil are separated by a rib.

13. The vane as recited in claim 12, wherein the flow control feature is adjacent to an end of the rib.

14. The vane as recited in claim 13, wherein the flow control feature is arcuate.

15. The vane as recited in claim 13, further comprising a support that extends between a plug body and the flow control feature, wherein the support is transverse to the flow control feature.

16. The vane as recited in claim 11, wherein the casting plug is additively manufactured and the component is cast.

17. The vane as recited in claim 11, wherein the flow control feature extends into the flow path within the airfoil of the component to be adjacent to an end of a rib within the airfoil.

18. A method for manufacturing a component for a gas turbine engine, the method comprising:

welding a casting plug into a core support aperture of a vane, the casting plug comprising a flow control feature that extends into a flow path within a vane airfoil to at least partially define a turn region of at least one of a plurality of flow passages within the vane airfoil.

19. The method as recited in claim 18, wherein a thickness of the support controls the cooling flow through the at least one of the plurality of flow passages within the component.

20. The method as recited in claim 18, further comprising additively manufacturing the casting plug and casting the component.

21. The method as recited in claim 18, wherein flow control feature extends into the flow path within the vane airfoil adjacent to an end of a rib within the vane airfoil.

* * * * *